US005804783A

United States Patent [19]

Breed

[11] Patent Number: 5,804,783

[45] Date of Patent: Sep. 8, 1998

[54] AIR DAMPED CRASH SENSOR AND CONSTRUCTION METHOD THEREOF

[75] Inventor: David S. Breed, Boonton Township, N.J.

[73] Assignee: Automotive Technologies International, Inc., Boonton Township, Morris County, N.J.

[21] Appl. No.: 476,881

[22] Filed: Jun. 7, 1995

[51] Int. Cl.[6] ..... H01H 35/14

[52] U.S. Cl. ..... 200/61.45 R; 200/61.48; 200/61.49

[58] Field of Search ..... 200/61.45 R–61.45 M, 200/61.46, 61.47, 61.48, 61.49, 61.5, 61.51, 61.52, 61.53; 29/592, 592.1, 622, 837, 854–856; 439/604, 874, 894

[56] References Cited

U.S. PATENT DOCUMENTS

| | | | |
|---|---|---|---|
| 4,664,959 | 5/1987 | Flanagan et al. | 339/28 |
| 5,155,307 | 10/1992 | Breed et al. | 200/61.45 R |
| 5,231,253 | 7/1993 | Breed et al. | 200/61.45 R |
| 5,389,751 | 2/1995 | Breed | 200/61.45 R |

*Primary Examiner*—Lincoln Donovan
*Assistant Examiner*—Michael A. Friedhofer
*Attorney, Agent, or Firm*—Samuel Shipkovitz

[57] ABSTRACT

An air damped crash sensor including a thin planar hinged inertial sensing mass which rotates within a sealed housing with a small clearance between the edges of the mass and the walls of the housing so as to create a restriction to the flow of a gas from one side of the sensing mass to the other side as the sensing mass rotates in response to accelerations during a crash of an automobile. The flow of gas within the sealed housing is designed to be in the inertial regime such that the damping force on the mass is proportional to the velocity of the mass squared and thus affected by the gas density but not temperature. The sensor may include (i) a thin hinge which is insert molded into the sensing mass and sensor body through a unique two step molding process whereby the hinge, typically made of plastic, is supported so that it does not deform, (ii) gas storage reservoirs placed to the side of the main cavity, (iii) a biasing contact designed so that it remains in contact with the sensing mass during the crash, and (iv) optionally an integral connector. With these elements, the sensor is ideally suited for sensing side impacts for the purpose of deploying a side impact passenger protection device.

20 Claims, 8 Drawing Sheets

AIR DAMPED CRASH SENSOR AND CONSTRUCTION METHOD THEREOF

BACKGROUND OF THE INVENTION

This invention is an improvement on the sensors described in U.S. Pat. Nos. 5,231,253, 5,155,307 and 5,192,838 which are included herein by reference. Several problems have arisen with the sensor design as shown in FIGS. 1 and 2 of U.S. Pat. No. 5,231,253. The first relates to the hinge and the method of insert molding it into the sensing mass and housing. The design shown in FIG. 2, of U.S. Pat. No. 5,231,253, uses a rather narrow hinge which is relatively thick. In some designs this geometry does not provide sufficient support against rotation of the sensing mass about axes perpendicular to the axis of the hinge with the result that the sensor, especially when significant cross axis vibrations are present, exhibits erratic performance. It has been found that if the hinge is made so that it extends substantially along the length of the edge of the sensing mass, the erratic performance is substantially eliminated. However, now the hinge must be made substantially thinner which complicates the insert molding process. In particular, this newly designed hinge is typically made from plastic with a thickness about 0.004 inches. Such a hinge is not sufficiently rigid to withstand the forces of the liquid plastic during the molding operation and, as a result, the hinge wrinkles and deforms and becomes inoperable.

A second problem arises when the sensor is located near the surface of the outer door panel on the side of a vehicle which is subjected to a side impact and where the impact occurs proximate to the sensor. Such an impact creates very high accelerations of the sensor which are sufficient to cause the biasing contact to move away from the sensing mass and momentarily touch the fixed contact. This can cause an inadvertent airbag deployment or cause a non-deployment failure of the electric squib which normally initiates deployment of the airbag. In this latter case, a momentary flow of current for a few microseconds duration can cause the squib to fail as a dud.

A third problem arises in some geometries where the sensing mass area is more than about 1 square inch and where the sensor is used for sensing side impacts. Substantial air volume is required behind the sensing mass in order to achieve a response curve such as shown in FIG. 10 of U.S. Pat. No. 5,231,253. If this air volume is placed further outside of the sensing mass, the sensor becomes excessively thick for some installations. For some vehicles, there is little space in a direction perpendicular to the door at the place inside the door where the sensor should be mounted, for example. For these cases, the sensor must be as thin as possible.

Finally, in order to keep the cost of sensors to a minimum, the connector must be integral with the sensor. The operation of this sensor can be seriously affected by moisture or changes in gas density and a near hermetic seal is therefore required. Some currently used sensors, such as the ball-in-tube sensor, permit some gas to flow in and out of the sensor. The behavior of the ball-in-tube sensor is relatively unaffected by the density of the gas within the sensor since its performance is determined by the viscosity of the gas which is relatively independent of gas density. The improved sensor of this invention, on the other hand, depends on the inertial properties of the gas, rather than the viscosity, and therefore the density of the gas within the sensor is important.

These and other problems associated with the sensors described in the above reference patents are solved in the improved sensor described below.

SUMMARY OF THE INVENTION

The sensor of this invention comprises a thin rectangular hinged inertial sensing mass which rotates within a housing with a small clearance between the edges of the mass and the walls of the housing so as to create a restriction to the flow of a gas from one side of the sensing mass to the other side as the sensing mass rotates in response to accelerations characteristic of a crash. The flow of gas is in the inertial regime and thus affected by the gas density. The improvements comprise (i) the use of a thin hinge which is insert molded into the sensing mass and sensor body through a unique two step molding process whereby the plastic film hinge is supported so that it does not deform, (ii) the placement of gas storage reservoirs to the side of the main cavity, (iii) the design of the biasing contact so that it remains in contact with the sensing mass during the crash, and (iv) an improved integral connector and seal design. The combination of these improvements renders the sensor ideally suited for sensing side impacts for the purpose of deploying a side impact passenger protection device. The principal objects and advantages of this improved sensor, among others, are:

1. To provide a hinge for connecting the sensing mass to the housing which resists rotations of the sensing mass about axes perpendicular to the intended rotation axis.
2. To provide a sensor having the minimum thickness in the sensing direction for mounting within the side of a vehicle.
3. To provide a sensor with an improved integral connector sealing system to prevent the leakage of gas into or out of the sensor.
4. To provide a sensor with a biasing contact which does not cause intermittent premature contact closures under high accelerations.

Other objects and advantages of this invention will become apparent from the disclosure which follows.

DETAILED DESCRIPTIONS OF THE PREFERRED EMBODIMENTS

This sensor was designed primarily for use in side impacts where the thickness of the sensor in the sensing direction is required to be small especially when the sensor is mounted within the door of a compact vehicle. The doors of such vehicles are already thin and the window mechanism consumes a significant portion of the available space and bisects the remaining space. In order to keep the size of the clearance between the sensing mass and the housing as large as possible, the sensing mass is also made thin and light. Analysis of this sensor shows that a significant air volume is required, as much as one cubic inch, in order to achieve the desired response curve. If this air volume were to be added in front of the sensing mass, the thickness of the sensor could approximately triple and would no longer fit within the allowed space. In order to avoid this problem, the requisite air volume has been placed outside of the main cavity but alongside it as shown in FIG. 1A.

Figure 1A:
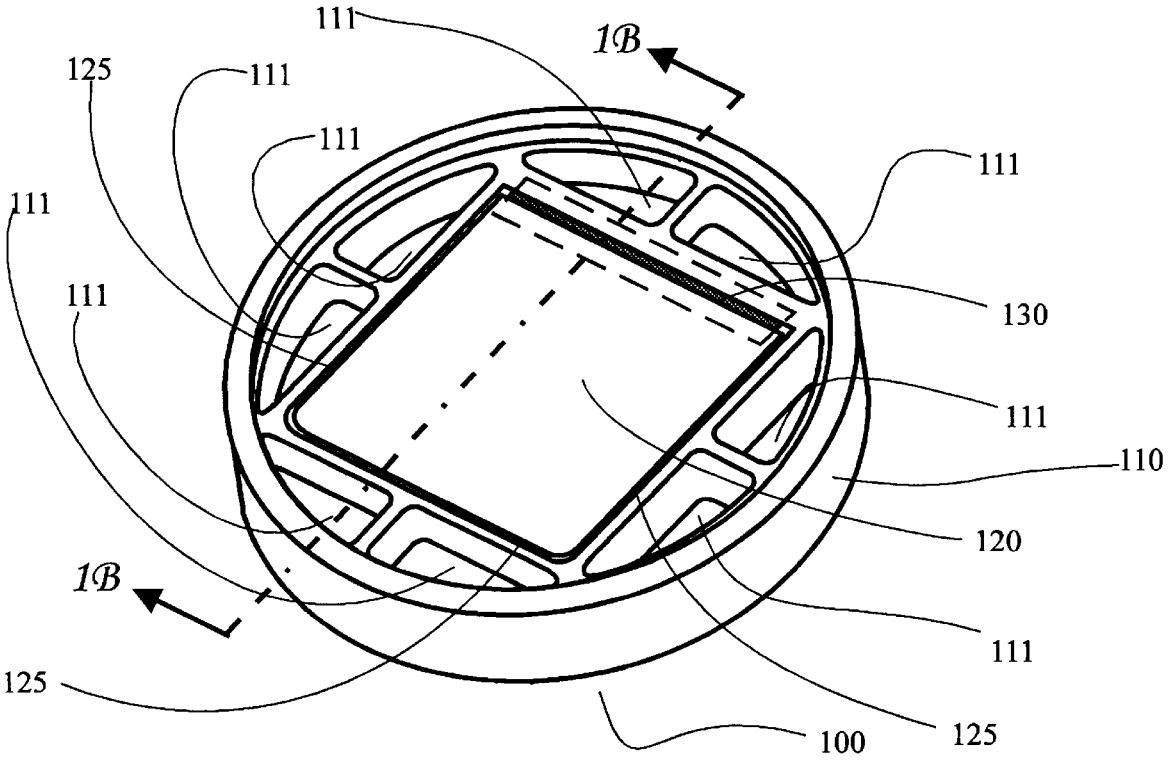
FIG. 1A is a perspective view, with the covers and connector removed, of a thin side impact sensor of this invention showing a thin sensing mass and a hinge attached to the sensing mass and to the housing, permitting the sensing mass to rotate within the main cavity, and showing the gas reservoirs adjacent the main cavity.

The body and hinged sensing mass assembly is shown generally at 100 in FIG. 1A. The top and bottom covers and the connector are removed from the sensor and therefore not shown FIGS. 1A and 1B. The body 110 no 110 in FIG. 1A contains fluid reservoirs 111. The sensing mass 120 is rotatably attached to body 110 by hinge 130. A portion 131 of hinge 130 is surrounded by the plastic forming the sensing mass 120. Another portion 132 of hinge 130 is surrounded by the plastic forming the housing 110. A third portion 133 of hinge 130 is not surrounded by plastic and thus is free to bend thereby permitting sensing mass 120 to rotate relative to housing 110.

When mounted in the door of a vehicle, the top of the sensing mass and housing assembly is toward the inside of the vehicle and the bottom toward the outside of the vehicle. A biasing force, as described below, exerts a force on the sensing mass in the direction of F in Fig. 1B. When the sensor is accelerated in the direction of F the inertia of sensing mass 120 permits the housing to move relative to the sensing mass which causes an increase in the gas pressure in cavity 112 and a corresponding decrease in gas pressure on the other side of the sensing mass and also in reservoirs 111. Top and bottom covers, not shown in this view, prevent gas from flowing into cavity 112 and cavity 111 from the atmosphere external to the sensor. Gas therefore begins to flow from cavity 112 into cavity 113 through the clearance 125 between sensing mass 120 and housing 110. This clearance 125 occurs on three sides of the sensing mass and restricts the flow of gas from cavity 112 to cavity 113. Gas also flows from cavities 111 into cavity 113, as the gas expands, equalizing the pressure in both cavities. By properly designing the sensor geometry, as described in more detail in the above referenced patents, the desired sensor response, whereby the sensor triggers on airbag desired crashes and does not trigger when the airbag is not needed, can be achieved.

A catch 162 provided in the bottom of the sensing mass to hold the biasing contact, not shown in this view but shown as 310 in FIG. 3A, against the sensing mass so that it remains in contact with the sensing mass under high accelerations as described in more detail below. Also, the wall of the housing 172 which is directly opposite the hinge 130 is shown having a curved surface so as to mate with the sensing mass as it rotates from the initial position to the actuating position. That is in the configuration of FIG. 1B, a constant clearance is maintained throughout the entire rotation of the sensing mass. It is easier to make a mold if this surface is flat as shown as 172 in FIG. 1C. In this case the surface is at an angle and designed so that, although the clearance changes, on average it is the same as in the case of FIG. 1B. It is important to making the sensor of this invention to be able to make the body and sensing mass during the same molding process. This is true since the tolerance on the clearance between the sensing mass and housing inner wall must typically be held to less than ±0.0005 inch which is difficult to do if the sensing mass and housing are made separately and assembled. If they are molded together in the same process the clearance is controlled by the tolerances in the mold which is within the state of the art of mold design and construction. This was disclosed in the above referenced U.S. Pat. No. 5,231,253. In that case, the hinge was narrow and was made sufficiently thick, such that with proper support within the mold using various pins, plastic could be made to flow around the hinge without significantly distorting it. The performance of this sensor, however, deteriorated significantly when subjected to cross axis vibrations during the crash. The problem was traced to the narrow hinge and a wide hinge extending most of the length along the attachment edge was required.

A wide hinge must be significantly thinner than a narrow hinge otherwise it will exert a significant torque on the sensing mass. An important part of this invention, therefore, is the insert molding technique described below, and shown in FIGS. 2A and 2B, which permits the mass and housing to be molded together along with the thin hinge. A preferred material for the hinge is KYNAR, i.e., polyvinylidene fluoride, which has a higher melting point than the polyester which is typically used for the body. The problem is that the hinge is very thin, about 0.004 inches, and must be supported when the plastic is pumped into the mold under high pressure, otherwise it becomes distorted which later interferes with the operation of the sensor. This problem was partially solved using the molding technique shown in FIG. 2A by supporting the hinge along one side and pumping the plastic only along the other side. This resulted in a hinge which was attached to the sensing mass only on one side and over time it would separate from the sensing mass and the sensor would fail. Nevertheless, if handled carefully, this system was successful.

Figure 2A:
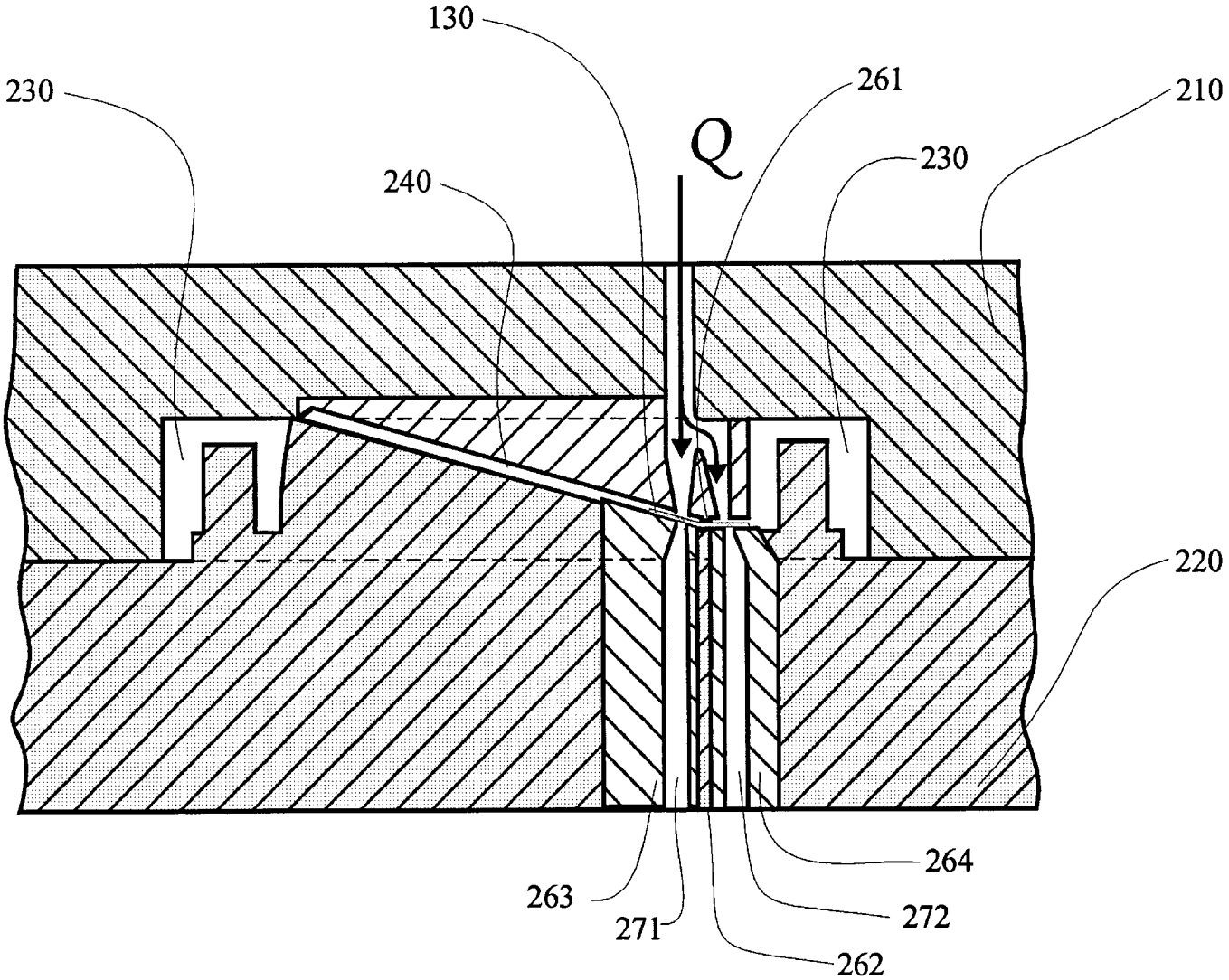
FIG. 2A is a view illustrating the first stage of a method of molding the housing, sensing mass and hinge assembly showing the support for the hinge while plastic is injected through a first port.
Figure 2B:
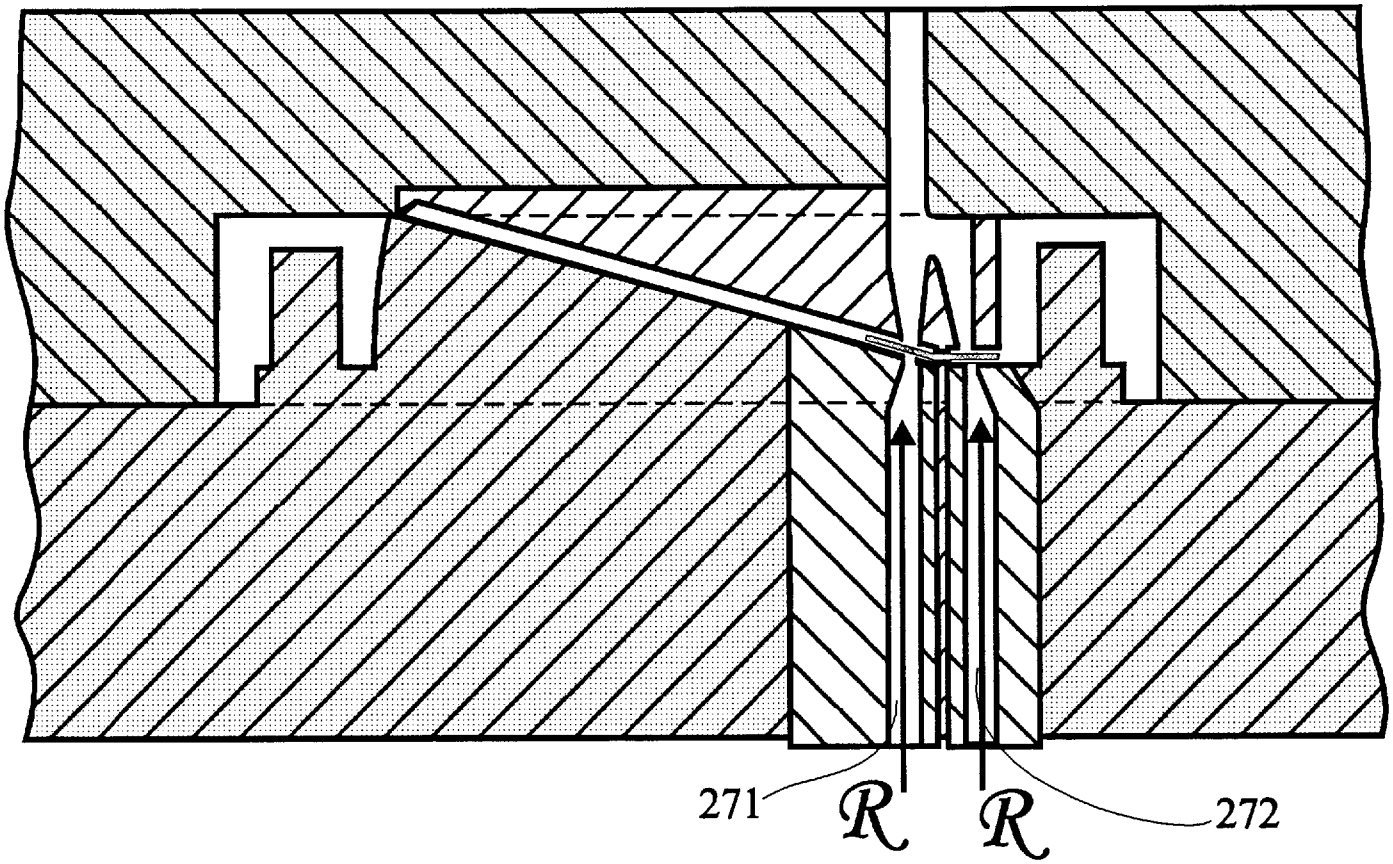
FIG. 2B is a view illustrating the second stage of a method of molding the housing, sensing mass and hinge assembly showing the partial removal of the hinge support while plastic is injected through a second port.

The process was improved with the addition of the molding step shown in FIG. 2B where in a second step the support for the hinge is removed and plastic is injected onto the other side of the sensing mass. In this manner the sensing mass encloses the hinge on both sides and the hinge is prevented from separating from the sensing mass.

In FIG. 2A an upper mold portion 210 is shown assembled with lower mold section 220 to define cavities 230, for the reservoirs and housing, and 240 for the sensing mass. The hinge 130 is shown placed within the mold where it is supported by fixed ridges 261 and 262 and movable supports 263 and 264. During this stage I configuration, plastic is pumped into the mold as shown by arrows Q. During this phase, plastic fills the cavities 230 and 240. After the plastic has partially cooled, movable supports 263 and 264 are withdrawn slightly and plastic is now pumped through passages 271 and 272 in the lower portion 220 of the mold as indicated by arrows R in FIG. 2B. In this second stage plastic flows to fill the volume below the hinge 130 thus completing encapsulation of hinge 130 except for the space occupied by fixed supports 261 and 262. It has been discovered that for very short crash pulses (<10 milliseconds), the biasing contact, as shown in the above referenced U.S. Pat. No. 5,231,253, can bend and actually separate from the sensing mass, engage the second contact and trigger the airbag before the sensing mass has traveled to the firing position. In other words, the acceleration acting on the mass of the contact overcomes the spring force tending to hold the contact against the sensing mass. This has the effect of causing a premature firing of the airbag. To prevent this from happening, the contact should be designed so as not to separate from the sensing mass when exposed to an acceleration of 250 g's for 2 milliseconds or greater. To solve this problem, the contact can either be made round, or approximately square, rather than as a flat strip as shown in the referenced patent, or it must be attached to the sensing mass. FIGS. 3A and 3B depict the square and round cross section examples. The second contact normally receives support by resting against the bottom cover. In some cases, a recess in the bottom cover is provided to permit the second contact to travel as it is being engaged by the first contact in order to provide for overtravel and thus a longer duration of contact closure.

Figure 1B:
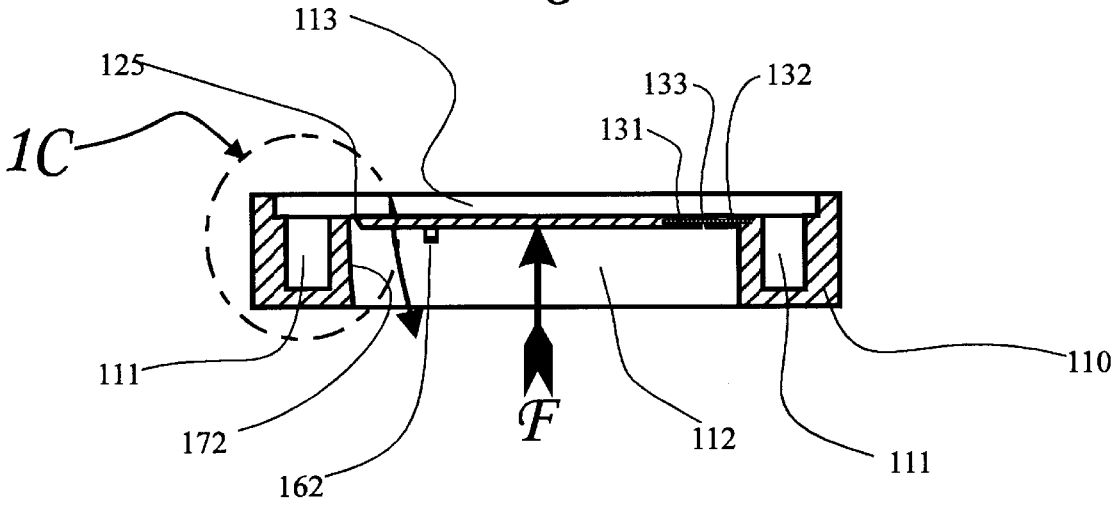
FIG. 1B is a cross section view of the sensor of FIG. 1 taken along lines 1B—1B in FIG. 1.
Figure 1C:
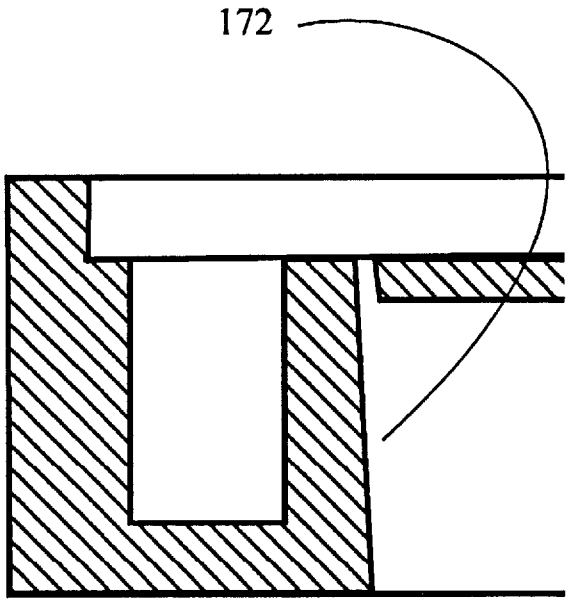
FIG. 1C is a expanded view of a portion of the sensor of FIG. 1B taken from circle 1C of FIG. 1B illustrating a flat housing interior wall.
Figure 3A:
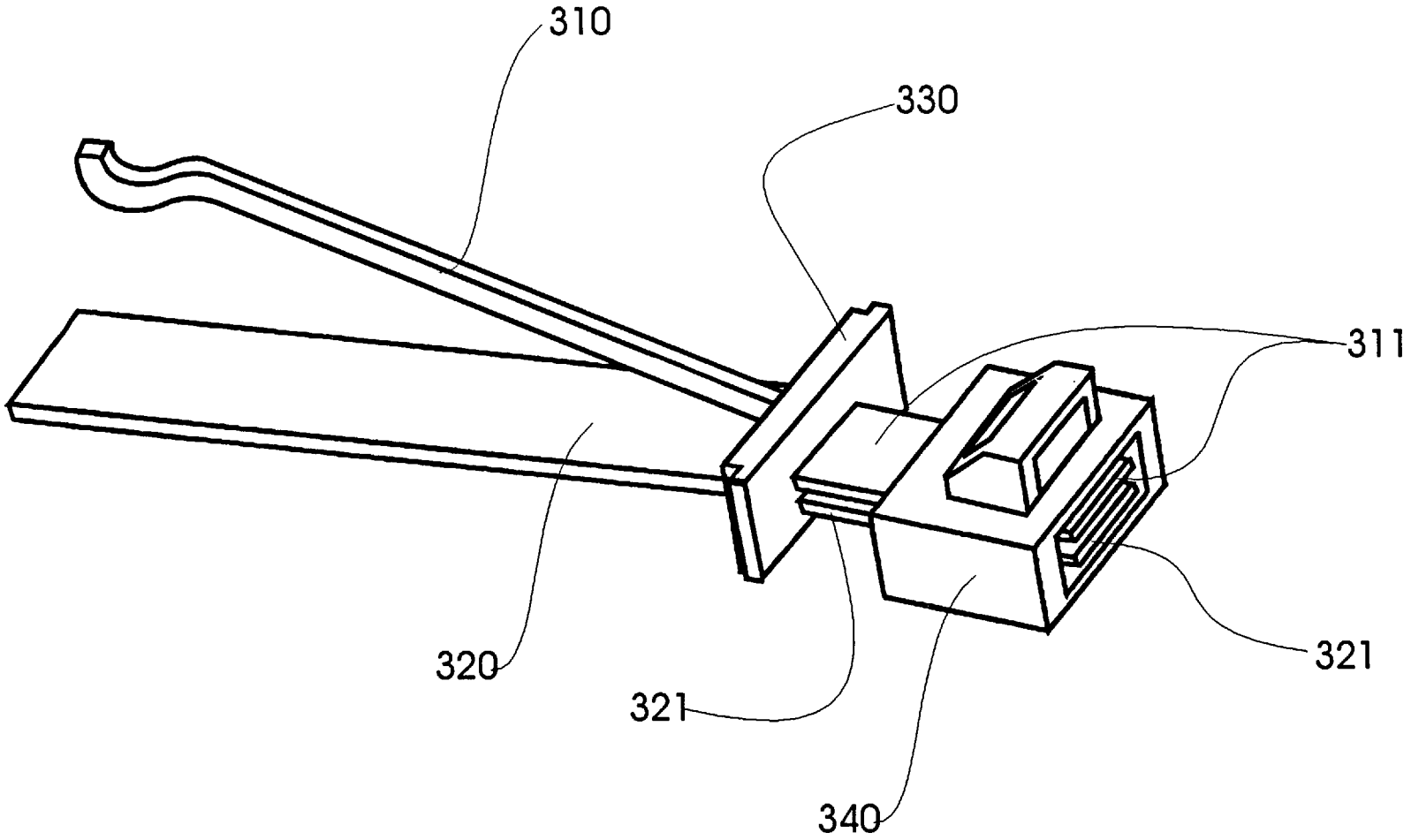
FIG. 3A is a detail of one implementation of the contacts of FIG. 1 where the contact is shown with a square cross section.
Figure 3B:
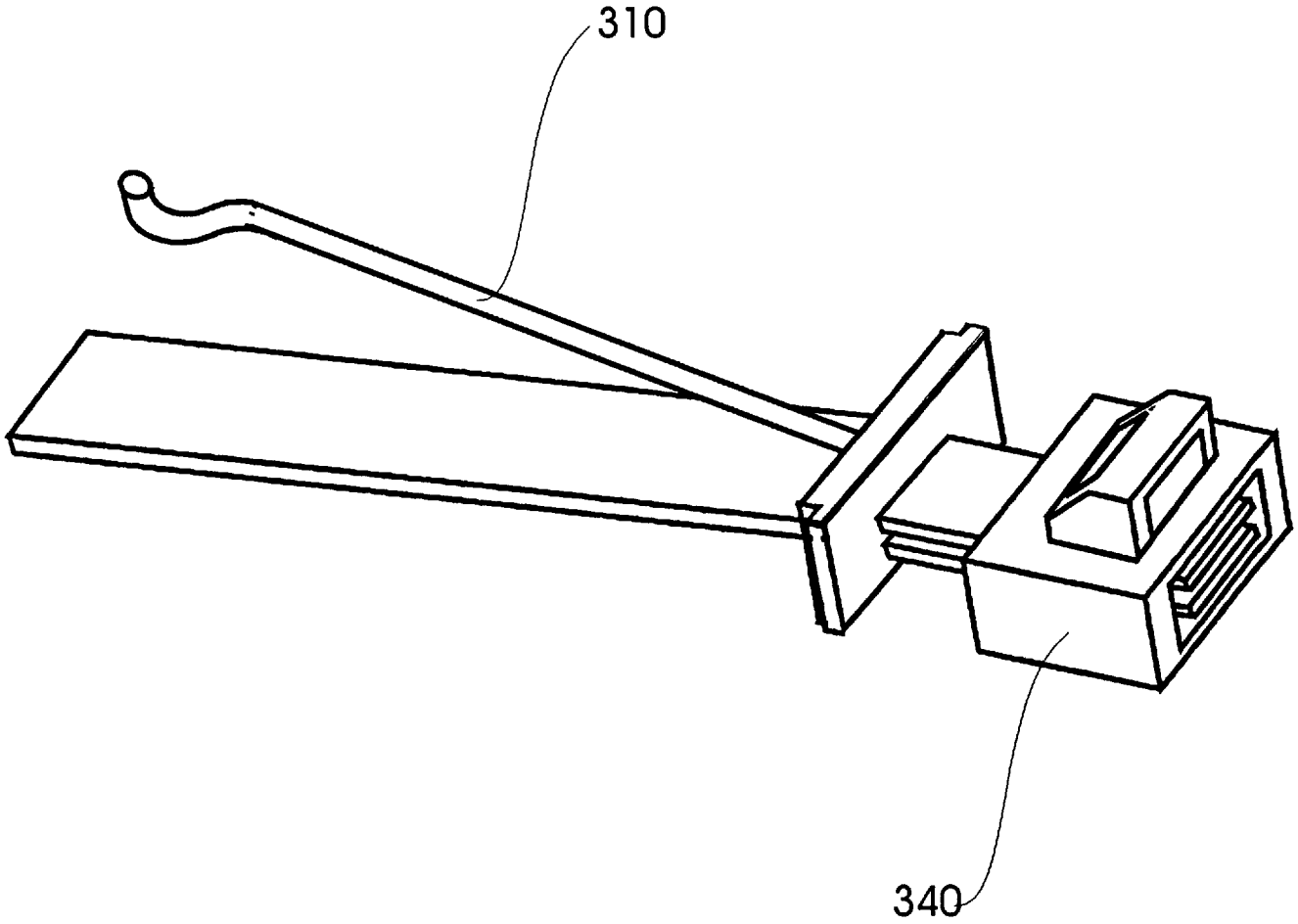
FIG. 3B is a view as in FIG. 3A showing an alternate implementation where the contact has a round cross section.

FIG. 3A illustrates a preferred connector and contact assembly using a biasing contact having a square cross section. The biasing contact 310 is formed along with the connector spade 311 in a forming operation. Secondary contact 320 is rectangular in cross section and also formed along with connector spade 321. These combination contacts and spades are joined together with holder 330 and connector housing 340 in an insert molding or separate assembly operation. FIG. 3B is identical to FIG. 3A except the cross section of the biasing contact 310 is round instead of square. Naturally other geometries are possible such that the biasing contact 310 continues to contact the sensing mass when exposed to accelerations found in a direct impact to the sensor location on the subject vehicle. In some cases, it will be necessary to attach the biasing contact to the sensing mass to prevent the contact from separating from the sensing mass. A catch 162 for accomplishing this is shown in FIG. 1B.

Figure 4A:
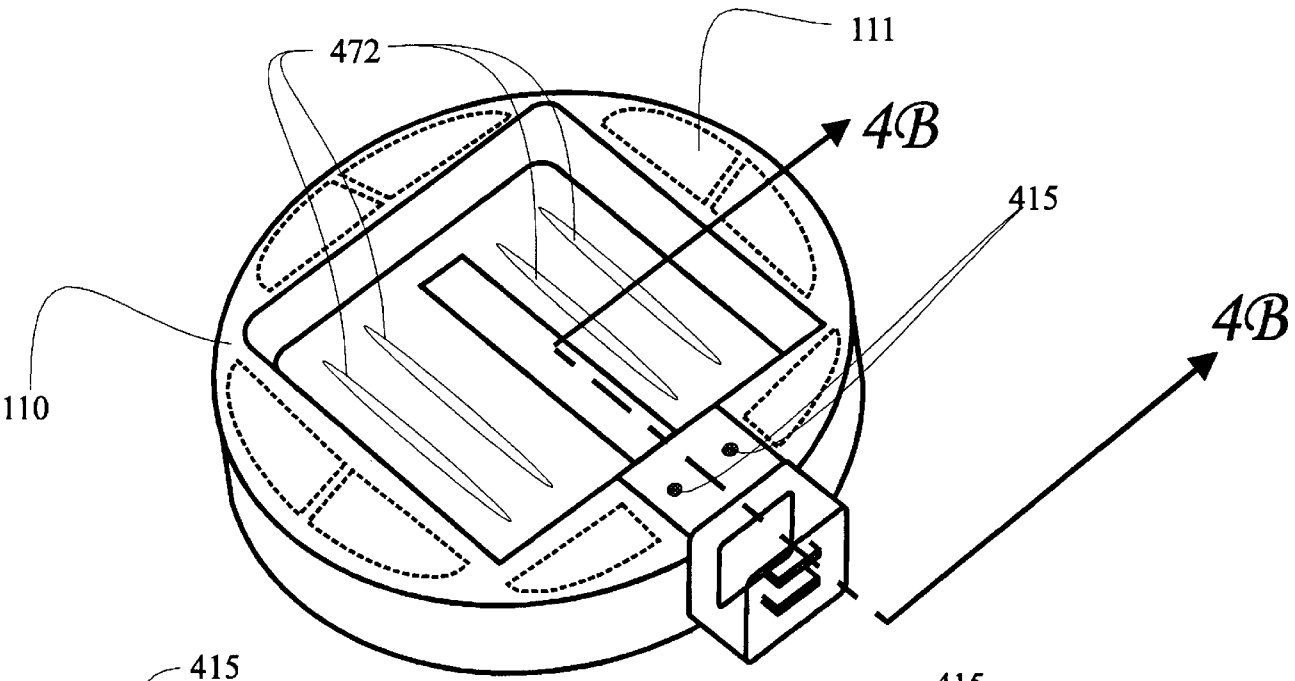
FIG. 4A is a perspective view of the sensor of FIG. 1, with the sensor covers removed, showing an integral connector and illustrating a preferred sealing method.
Figure 4C:
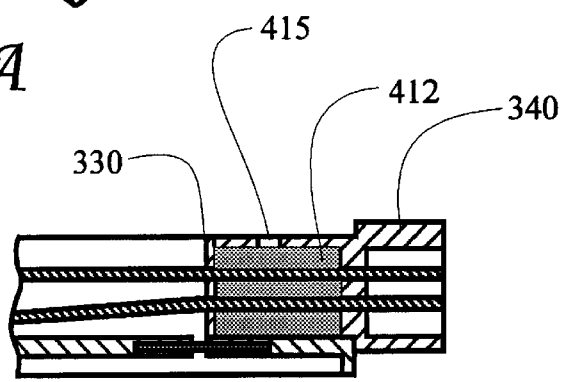
FIG. 4C is a cross section view taken along line 4B—4B showing a detail of the connector sealing system after the introduction of the sealing material.
Figure 4B:
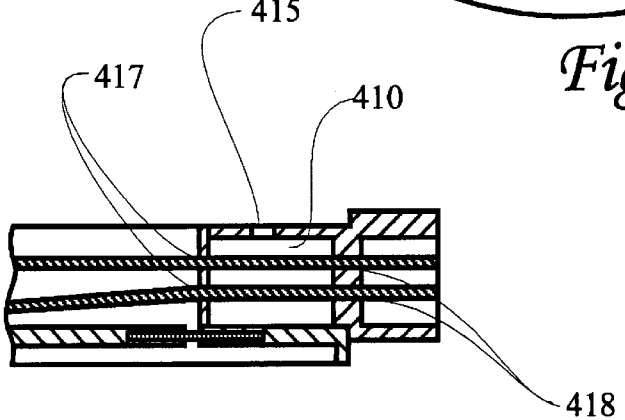
FIG. 4B a cross section view taken along line 4B—4B showing a detail of the connector sealing system prior to the introduction of the sealing material.

The final improvement required to make the practical low cost side impact sensor of this invention, is to incorporate an integral connector into the sensor as shown in FIGS. 4A, 4B and 4C. The problem to be solved is that the sealing method used cannot leak since, as discussed above, the density of the gas within the sensor must remain constant over the life of the sensor otherwise the sensor calibration will change. A novel sealing method was developed to solve this problem. Basically, a mold cavity 410 is formed where the integral connector 340 and contact holder 330 are combined with the sensor body 110. This mold cavity 410 is designed so that when urethane rubber 412, or other appropriate material, is pumped under pressure into the mold cavity 410 through fill holes 415, it fills the cavity 410 displacing the air which flows out through the small clearances 417 and 418 between the metal contacts and spades and the plastic. If these parts were combined with an insert molding process, provision must be made for there to be a slight leakage path between the parts to permit the air to flow but prevent the high viscosity urethane from flowing.

This sealing design has been subjected to the severest tests without failure. In particular, sample sensors were subjected to a temperature of −40° Celsius for an extended time period and then immersed in boiling water followed by immersion in water at 0° Celsius. The sensors were examined for leaks and the process repeated. A fluorescent dye in the water penetrates the sensors in the event of a leak. After numerous cycles the sensors were disassembled, cut apart and studied for the presence of fluorescent dye inside the sensors. None was found. In contrast, a production ball-in-tube sensor failed on the first cycle.

FIG. 4 illustrates another feature whereby reinforcing ribs 472 have been placed on the underside of the sensing mass to add strength without adding substantial mass.

Figure 5:
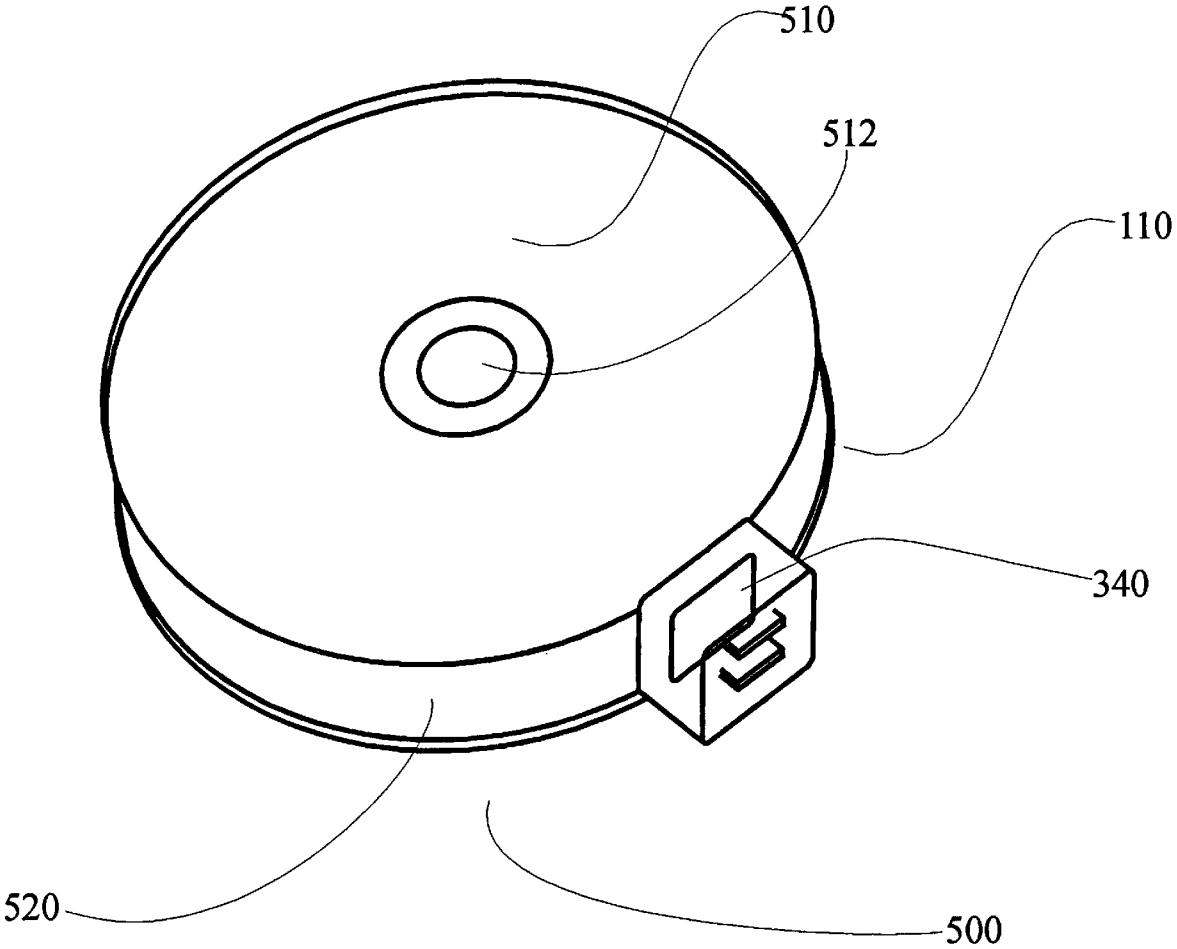
FIG. 5 is a perspective view of the complete sensor assembly.

Each of the improvements discussed and illustrated above combine together to form a sensor which satisfies the advantages and objectives described above and results in a superior sensor for sensing side impacts. Naturally, the sensor also has applicability for sensing crashes from other directions such as frontal and rear impacts if mounted in an appropriate location. However, its main advantage is for sensing side impacts. An assembly view, shown in perspective, of a sensor incorporating these improvements is illustrated in FIG. 5. In FIG. 5 upper cover 510 and lower cover 520 are shown attached to sensor body 110. These covers are attached by friction welding, for example, or by any other convenient method. The sensor shown generally as 500 is attached to an appropriate portion of the vehicle proximate to the outside by means of brackets, not shown, or other convenient attachment method. In some installations the bracket or attachment means is made part of the sensor housing or cover.

The center 512 of the top cover 510 illustrates a method of adjusting the sensitivity of the sensor after it has been assembled. During the manufacture of the sensor, the sensor is purposely made too insensitive, that is the travel of the mass is too long. After the sensor is completely assembled, it is tested and the amount of reduction in sensing mass travel is calculated to make the sensor have the correct calibration. A heated rod is then placed against the top 510 of the sensor and displaced a precise amount which forms a depression 512 in cover 510. Since the sensing mass is resting against this cover, the initial position of the mass is changed by just the amount calculated to bring the sensor into calibration. In this manner, manufacture of the sensor is made easier since now each sensor can be point calibrated after it has been completely assembled.

Although several preferred embodiments are illustrated and described above, there are possible combinations using other geometry, material, and different dimensions of the components that can perform the same function. Therefore, this invention is not limited to the above embodiments and should be determined by the following claims. In particular, although the particular sensor described in detail above requires all of the improvements described herein to meet the goals and objectives of this invention, some of these improvements may not be necessary if the sensor is used for sensing frontal impacts, for example.

What is claimed is:

1. In a vehicle having a deployable passive restraint device, a sensor for detecting that said vehicle is experiencing a crash requiring deployment of said passive restraint device comprising:

(a) a housing having an inboard end, an outboard en and a main cavity within, said main cavity being defined by side walls;

(b) an inboard cover for closing said inboard end of said housing;

(c) an outboard cover for closing said outboard end of said housing;

(d) a mass disposed within said main cavity and rotatable relative to said housing from a first at rest position where said mass is adjacent to said inboard cover of said housing to a second triggering position, closer to said outboard end of said housing, in response to accelerations of said housing, a space being defined between said inboard cover and said mass on a first side of said mass, said mass in cooperation with said main cavity side walls forming a clearance there between, said clearance creating a restriction to flow of a fluid between the space on the first side of said mass closer to said inboard cover and a space on a second side of said mass closer to said outboard cover;

(e) a hinge insert molded into said mass and said housing permitting said mass to rotate within said main cavity;

(f) means defining at least one fluid storage cavity within said housing in fluid communication with said space between said inboard cover and said mass on said first side of said mass, said at least one fluid storage cavity being arranged at a location other than between said mass and said inboard cover;

(g) an integral connector;

(h) a first contact means attached to said housing and coupled to said integral connector, extending within said main cavity and engaging and applying a force to said mass holding said mass at said first at rest position prior to a crash, said first contact means movable with said mass from said first at rest position to said second triggering position;

(i) means to prevent said first contact means from disengaging with said mass during an acceleration of 250 G's for 0.002 seconds; and (j) a second contact means attached to said housing, extending within said main cavity and positioned to be engaged by said first contact means when said mass moves to said second triggering position to deploy the passive restraint device, said second contact means being coupled to said integral connector;

wherein, as said mass rotates relative to said housing in response to accelerations of said housing, a pressure difference is created between the space on the first side of said mass and the space on the second side of said mass which is gradually reduced by the flow of fluid through said clearance into the space between said mass and said inboard cover and from said at least one fluid storage cavity into the space between said mass and said inboard cover without passing through said clearance to thereby retard the motion of said mass.

2. The invention in accordance with claim 1, wherein said housing comprises a substantially circular peripheral wall, said at least one fluid storage cavity being arranged between said side walls defining said main cavity and said circular peripheral wall of said housing.

3. In a vehicle having a deployable passive restraint device, a sensor for detecting that said vehicle is experiencing a crash comprising:

(a) a housing having an inboard end, an outboard end and a main cavity within, said main cavity being defined by side walls;

(b) an inboard cover for closing said inboard end of said housing;

(c) an outboard cover for closing said outboard end of said housing;

(d) a mass disposed within said main cavity and rotatable relative to said housing from a first at rest position where said mass is adjacent to said inboard cover to a second triggering position, closer to said outboard end of said housing, in response to accelerations of said housing, a space being defined between said inboard cover and said mass on a first side of said mass, said mass in cooperation with said main cavity side walls forming a clearance there between, said clearance creating a restriction to flow of a fluid between the space on the fist side of said mass closer to said inboard cover and a space on a second side of said mass closer to said outboard cover;

(e) a hinge attached to said mass and to said housing permitting said mass to rotate within said main cavity;

(f) means defining at least one fluid storage cavity within said housing outside of, adjacent to and in fluid communication with said space between said inboard cover and said mass on the first side of said mass, said at least one fluid storage cavity being situated at a location other than between said mass and said inboard cover; and (g) mass movement detection means for detecting that said mass has moved to said second triggering position to initiate deployment of the passive restraint device;

wherein, as said mass rotates relative to said housing in response to accelerations of said housing, a pressure difference is created between the space on the first side of said mass and the space on the second side of said mass which is gradually reduced by the flow of fluid through said clearance into the space between said mass and said inboard cover and from said at least one fluid storage cavity into the space between said mass and said inboard cover without passing through said clearance to thereby dampen the motion of said mass.

4. The invention in accordance with claim 3 wherein said housing and said mass are made from plastic and said hinge is made from a plastic having a higher melting point than the plastic used for said housing and said mass.

5. The invention in accordance with claim 4 wherein said plastic hinge is made from Polyvinylidene Flouride.

6. The invention in accordance with claim 4 wherein said mass is substantially rectangular and includes reinforcing ribs.

7. The invention in accordance with claim 3 wherein said main cavity is substantially rectangular and defined by four of said side walls, and wherein said mass is attached to a first one of said side walls by said hinge and a second one of said side walls opposite said first side wall has a substantially planar form.

8. The invention in accordance with claim 3 further comprising control means for controlling displacement of said mass between said first at rest position and said second triggering position, said control means comprising a permanent deformation of said inboard cover.

9. The invention in accordance with claim 3 further comprising an integral connector coupled to said mass movement detection means.

10. The invention in accordance with claim 3, wherein said housing comprises a substantially circular peripheral wall, said at least one fluid storage cavity being arranged between said side walls defining said main cavity and said circular peripheral wall of said housing.

11. A method for molding a housing and sensing mass assembly for a crash sensor having a housing, said housing having a cavity therein and a sensing mass disposed within said cavity and rotatable relative to said housing, a hinge having a first portion within said sensing mass, a second portion between said sensing mass and said housing and a third portion within said housing, comprising the following steps:

(a) place said hinge into a mold adjacent a support member, said support member supporting one side of said first and said third portions of said hinge, and said mold having a housing cavity and a sensing mass cavity;

(b) close said mold and inject liquid plastic therein though a first injection port to fill said housing and sensing mass cavities, thereby substantially forming said housing and said sensing mass;

(c) remove said support member exposing a surface of said hinge at said first and said third portions and creating a cavity within said mold adjacent said hinge;

(d) inject liquid plastic into said mold though a second injection port, said plastic filling said cavity adjacent said first and third portions of said hinge thereby encapsulating said first portion of said hinge within said sensing mass and said third portion of said hinge within said housing; and (e) remove said housing and sensing mass assembly from said mold.

12. A crash sensor for a vehicle having a deployable passive restraint device, said sensor comprising:

(a) a housing having a front end, a rear end and a main cavity within, said main cavity having side walls;

(b) a front end cover for closing said front end of said housing;

(c) a rear end cover for closing said rear end of said housing;

(d) a mass disposed within said main cavity and rotatable relative to said housing from a first at rest position where said mass is adjacent to said rear end cover to a second triggering position, closer to said front end of said housing, in response to accelerations of said housing, a space being defined between said front end cover and said mass on a first side of said mass, said mass in cooperation with said main cavity side walls forming a clearance there between, said clearance creating a restriction to flow of a fluid between the space on the first side of said mass closer to said inboard cover and a space on a second side of said mass closer to said outboard cover;

(e) a hinge means attached to said mass and to said housing permitting said mass to rotate within said main cavity;

(f) a first contact means attached to said housing, extending within said main cavity and engaging and applying a force to said mass holding said mass at said first at rest position prior to a crash, said first contact means movable with said mass from said first at rest position to said second triggering position;

(g) disengagement prevention means for preventing said first contact means from disengaging with said mass during an acceleration of 250 G's for 0.002 seconds, said disengagement prevention means comprising said first contact means being attached to said mass; and (h) a second contact means attached to said housing, extending within said main cavity and positioned to be engaged by said first contact means when said mass moves to said second triggering position to deploy the passive restraint device.

13. The invention in accordance with claim 12 wherein said first contact means comprise a cantilevered beam contact.

14. The invention in accordance with claim 13 wherein said cantilevered beam contact has a circular cross section.

15. The invention in accordance with claim 13 wherein said cantilevered beam contact has a rectangular cross section.

16. The invention in accordance with claim 12, further comprising means defining at least one fluid storage cavity within said housing outside of, adjacent to and in fluid communication with said space between said inboard cover and said mass on the first side of said mass, said at least one fluid storage cavity being situated at a location other than between said mass and said inboard cover.

17. The invention in accordance with claim 12, wherein said housing comprises a substantially circular peripheral wall, said at least one fluid storage cavity being arranged between said side walls defining said main cavity and said circular peripheral wall of said housing.

18. The invention in accordance with claim 12, wherein said disengagement prevention means comprise a catch arranged on said mass and cooperating with said first contact to fixedly secure said first contact in connection with said mass.

19. A combination of an integral connector and an electrical device having a housing including an aperture extending between an interior of the electrical device housing and an exterior of the electrical device housing, said integral connector being at least partially situated within said aperture and comprising:

(a) at least two electrical conductors;

(b) a contact holder for holding said at least two electrical connectors in a position within an interior of the electrical device housing, a clearance being defined between said at least two electrical connectors and said contact holder;

(c) a connector housing spaced from said contact holder for retaining said at least two electrical connectors, a clearance being defined between said at least two electrical connectors and said connector housing, said contact holder, said connector housing and the electrical device defining a mold cavity in the aperture of the electrical device housing in which the portion of said at least two electrical connectors between said contact holder and said connector housing is situated, said clearances being of sufficient size permitting gas but not sealant to flow out of said cavity;

(d) a sealant which is flowable prior to injection into said cavity and which solidifies after injection into said cavity;

(e) at least one injection hole in the electrical device housing extending into connection with said cavity for enabling injection of said sealant into said cavity; and whereby, as said sealant is injected into said cavity through said at least one injection hole, air within said cavity is displaced and forced to flow out of said cavity through said clearances between said at least two electrical conductors and said contact holder and said connector housing permitting said cavity to completely fill with said sealant and thereby seal the electrical device from the ambient atmosphere.

20. The invention in accordance with claim 19 wherein said sealant is polyurethane.

* * * * *